US006561795B1

(12) United States Patent
Lasagni et al.

(10) Patent No.: US 6,561,795 B1
(45) Date of Patent: May 13, 2003

(54) BURNER FOR GASEOUS FUELS

(75) Inventors: Feliciano Lasagni, Via Liberta (IT); Giorgio Buccilli, Via della Palmarola (IT)

(73) Assignee: Worgas Bruciatori S.r.l., Formigine (IT)

( * ) Notice: Subject to any disclaimer, the term of this patent is extended or adjusted under 35 U.S.C. 154(b) by 0 days.

(21) Appl. No.: 09/403,991

(22) PCT Filed: Apr. 21, 1998

(86) PCT No.: PCT/EP98/02367

§ 371 (c)(1),
(2), (4) Date: Jan. 6, 2000

(87) PCT Pub. No.: WO98/49495

PCT Pub. Date: Nov. 5, 1998

(30) Foreign Application Priority Data

Apr. 28, 1997 (IT) ..... MO97A0077

(51) Int. Cl.[7] ..... F23D 14/58

(52) U.S. Cl. ..... 431/354; 239/556; 239/568

(58) Field of Search ..... 431/349, 354, 431/326, 328; 239/568, 566, 556

(56) References Cited

U.S. PATENT DOCUMENTS 6,461,152 B2 * 10/2002 Wood et al. ..... 431/354

FOREIGN PATENT DOCUMENTS

| | | | | |
|---|---|---|---|---|
| JP | 62108913 | * | 5/1987 | ..... 431/354 |
| JP | 56087712 | * | 1/1992 | ..... 239/556 |
| WO | 9201196 | * | 1/1992 | |

* cited by examiner

*Primary Examiner*—Sara Clarke
(74) *Attorney, Agent, or Firm*—Reising, Ethington, Barnes, Kisselle, Learman & McCulloch P.C.

(57) ABSTRACT

A burner fed with a hyper-stoichiometric mixture of air and gas-fuel comprises a diffuser on which rows of similarly shaped and evenly spaced parallel slots for the flow of said mixture are provided; said rows are separated from each other by an intermediate portion of diffuser having a substantially constant width and provided with further slots for the flow of said mixture, said further slots being non-parallel to said slots.

28 Claims, 4 Drawing Sheets

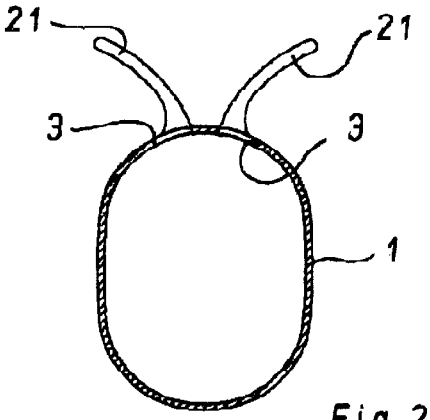
Fig. 2 - Prior Art
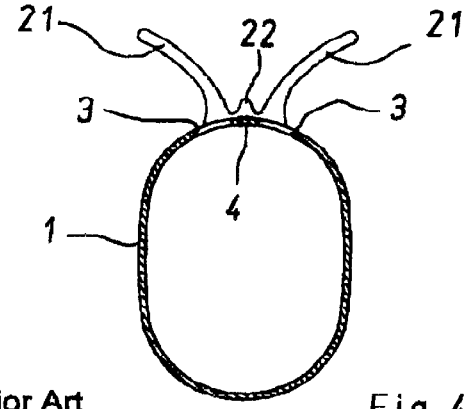
Fig. 4
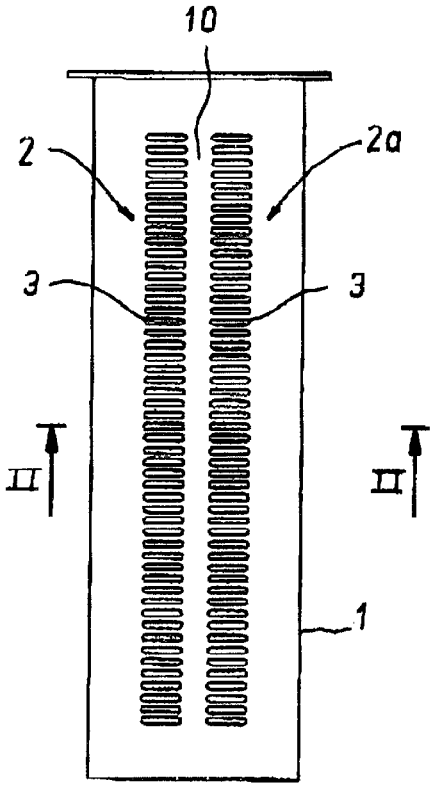
Fig. 1 - Prior Art
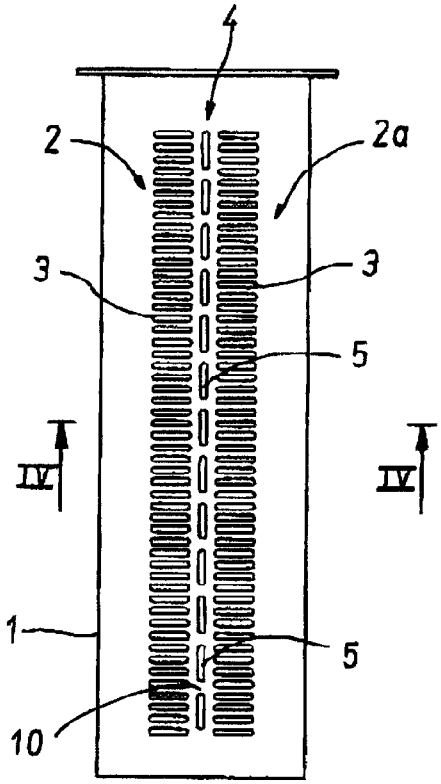
Fig. 3

BURNER FOR GASEOUS FUELS

FIELD OF THE INVENTION

The invention concerns a burner for gaseous fuels featuring low emissions of $NO_x$ and CO, particularly a burner fed with a hyper-stoichiometric mixture of fuel and air, that is with a quantity of primary air exceeding the stoichiometric value. The hyper-stoichiometric mixture makes it possible to reduce the temperature of the flames thus reducing the quantity of $NO_x$ formed during combustion.

DESCRIPTION OF THE PRIOR ART

Burners fed with a hyper-stoichiometric mixture involve the problem of flame stability because the flame tends to be extinguished intermittently and, as a consequence, to get detached from the surface of the burner, which causes an unsatisfactory operation of the burner, emission of unburned substances and high quantity of CO in the fumes produced by the combustion. If the ratio between air and fuel in the air-fuel mixture increases the instability of the flame increases as well. This problem may be made worse by the presence of air or nitrogen in the gaseous fuel feeding the burner and by pressure and moisture conditions of the environment wherefrom air, which is mixed with the gas fuel, is taken.

According to the state of art, one has tried to solve this problem by distributing discharge openings for the air-fuel mixture on the burner diffuser. The discharge openings are shaped as slots and are arranged in continuous or non-continuous rows separated from each other by a diffuser portion devoid of slots. A vacuum and a temperature higher than the temperature of the other parts of the diffuser are generated during combustion in the diffuser portion, which oppose flame extinction and consequent detachment of the flame from the surface of the burner.

However, the secondary air which laps the flames tends to cool them and to dilute further the mixture of air and gas-fuel flowing through the slots. Consequently, instability of the flame may occur when the aeration rate is high and a reduction of the content of $NO_x$ in the combustion products over a certain limit can not be achieved.

SUMMARY OF THE INVENTION

It is an object of the present invention to obtain a burner having a very low content of $NO_x$ in the combustion products and an improved stability of the flames.

The invention solves the above mentioned technical problem by adopting a burner fed with a hyper-stoichiometric mixture of air and gas-fuel, comprising a diffuser on which rows of first slots for a flow of said mixture are provided. The slots of each row are similarly shaped, evenly spaced and parallel to each other. The rows are parallel to each other and arranged on either sides of an intermediate portion of the diffuser having a substantially constant width; the intermediate portion being provided with further slots for the flow of the mixture that are non parallel to the first slots.

The further slots may be arranged in one or more continuous or non-continuous rows parallel to the median line of the intermediate portion of diffuser. The further slots may be arranged parallel to, or even inclined with respect to, the median line of the intermediate portion of diffuser, and may be rectilinear or curvilinear.

The burner of the invention has the advantage that auxiliary flames are generated in the intermediate portion of diffuser, between the main flames generated by two adjacent rows of first slots. The auxiliary flames heat those portions of the main flames facing towards the intermediate portion, thus preventing extinction of the main flames and their instability.

In an advantageous embodiment of the present invention, the further slots are so shaped that the speed of the mixture of air and gas-fuel flowing through them is lower than the speed of the mixture flowing through the first slots. This embodiment has the advantage that very stable auxiliary flames are generated, which act as anchor means for the main flames.

In a further advantageous embodiment of the present invention, the rate of flow of the mixture of air and gas-fuel flowing through the further slots of the intermediate portion of diffuser is lower than the rate of flow of the mixture flowing through the first slots. This result may be obtained by means of a whole surface of the further openings being substantially lower than the whole surface of the first slots, or by so shaping the further slots that the mixture is subject to heavy energy losses flowing through them. This embodiment has the advantage that the mixture of air and gas-fuel flowing through the further slots of the intermediate portion of diffuser does not affect significantly the structure of the flame formed on the rows of first slots.

In a further advantageous embodiment of the present invention the intermediate portion of diffuser comprises a heat-resistant material which may reach, without being damaged, a temperature higher than the remaining portions of the diffuser. This embodiment has the advantage that the mixture of air and gas-fuel flowing through the further slots is heated by the heat stored in the intermediate portion of the diffuser, which increases the combustion speed of the mixture allowing extremely stable auxiliary flames to be obtained that act as anchor means for the main flames.

In a further advantageous embodiment of the present invention, the heat-resistant material has a porous or spongy structure, which allows the mixture of air and gas-fuel to pass through it. The material having a porous or spongy structure may be a ceramic material. This embodiment has the advantage that the mixture of air and gas-fuel flowing through the further slots is heated and its speed is reduced at the same time.

In a further advantageous embodiment, the material having a porous or spongy structure is accommodated in a housing provided in the intermediate portion of the diffuser. This embodiment has the advantage of replacing the material quickly and easily, if necessary.

In a further advantageous embodiment, the heat-resistant material has a reticular structure. This embodiment has the advantage that the thermal deformations to which the material is subjected do not cause transmission of considerable mechanical stresses to the other parts of the burner.

BRIEF DESCRIPTION OF THE DRAWINGS

The invention will be now described in detail referring to the attached drawings, illustrating some embodiments of the invention, in which:

FIG. 1 is a top view of a burner according to the state of art, fed with a hyper-stoichiometric mixture of air and gas-fuel and provided with two uninterrupted rows of evenly spaced slots;

FIG. 2 is a section through a line II—II of FIG. 1;

FIG. 3 is a view as in FIG. 1, but showing a burner according to the invention provided with a row of further slots in the intermediate portion of diffuser between the two rows of slots;

FIG. 4 is a section through a line IV—IV of FIG. 3;

DETAILED DESCRIPTION OF THE PREFERRED EMBODIMENTS

Figure 5:
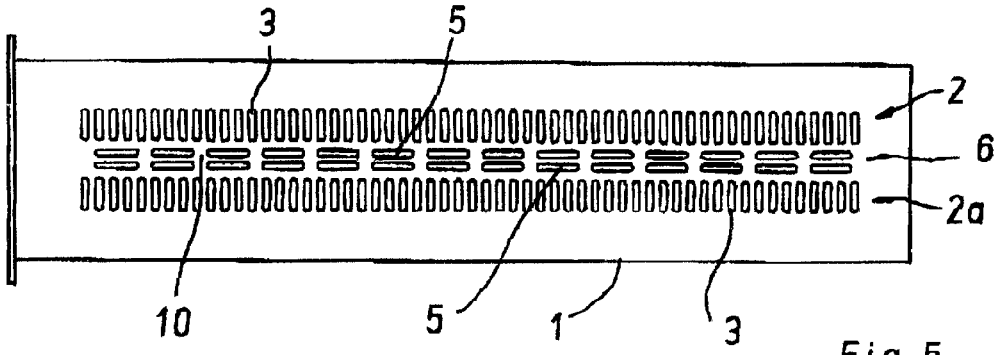
FIG. 5 is a view as in FIG. 4, but with two rows of further slots in the intermediate portion of diffuser between the two rows of slots.

With reference to FIGS. 1 to 15, reference numeral I denotes the diffuser of a burner provided on its surface with two uninterrupted rows 2 and 2*a* of openings, shaped as evenly spaced first slots 3, through which a mixture of air and gas-fuel flows. The mixture generates a pair of flames, for instance bladed flames. The rows 2 and 2*a* are separated from each other by an intermediate portion 10 of diffuser provided with further openings 5, shaped as further slots that are arranged in an uninterrupted row (FIG. 2). The further slots 5 are arranged parallel to a median line of the intermediate portion and are substantially perpendicular to the slots 3 of the rows 2, 2*a*. The mixture of air and gas-fuel exiting from said further slots 5 generates an auxiliary flame 22 which anchors the flames 21 on the surface of the diffuser, thus ensuring the stability of the flames even when the aeration rate of the mixture is very high.

FIG. 5 shows a diffuser I of a burner having two rows 6 of further slots 5 provided in the intermediate portion 10 of the diffuser, the further slots 5 being parallel to a median line of the intermediate portion 10 of the diffuser and substantially perpendicular to the first or main slots 3.

Figure 6:
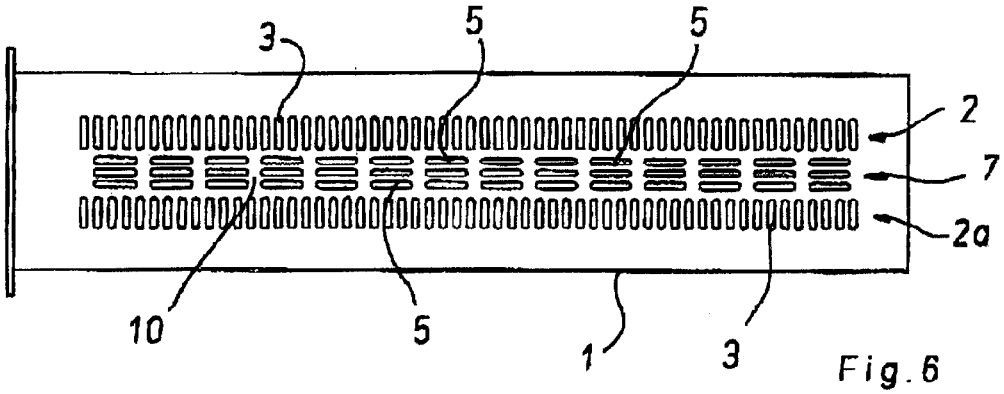
FIG. 6 is a view as in FIG. 4, but with three rows of further slots in the intermediate portion of diffuser between the two rows of slots.

FIG. 6 shows a diffuser I of a burner having three rows 7 of further slots 5 provided in the intermediate portion 10 of the diffuser, the further slots 5 being parallel to a median line of the intermediate portion 10 of the diffuser and substantially perpendicular to the slots 3.

Figure 7:
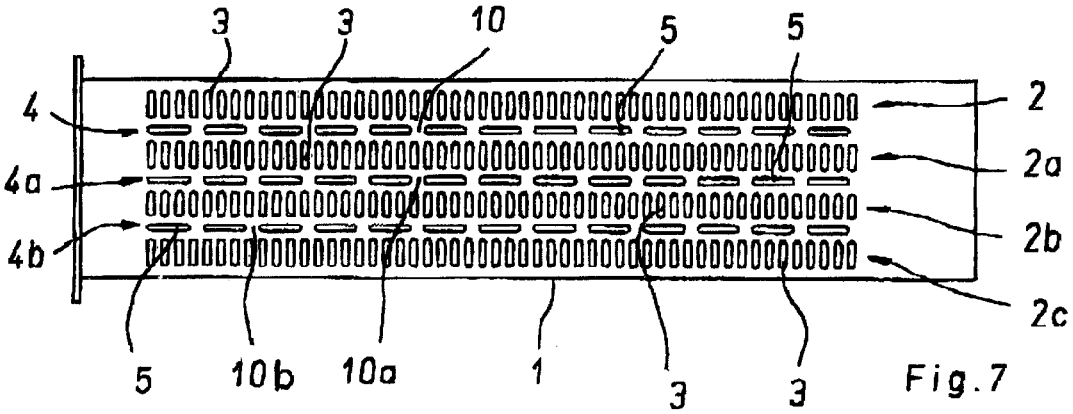
FIG. 7 is a view of a burner according to the invention, provided with four uninterrupted rows of slots, separated from each other by respective intermediate portions of diffuser each provided with a row of further slots.

FIG. 7 shows a diffuser I of a burner provided with four uninterrupted rows 2, 2*a*, 2*b*, 2*c* of slots 3, parallel to each other. Adjacent rows are separated from each other by respective intermediate portions 10, 10*a*, 10*b* of the diffuser, each of which is provided with a respective uninterrupted row 4, 4*a*, 4*b* of the further openings 5.

Figure 8:
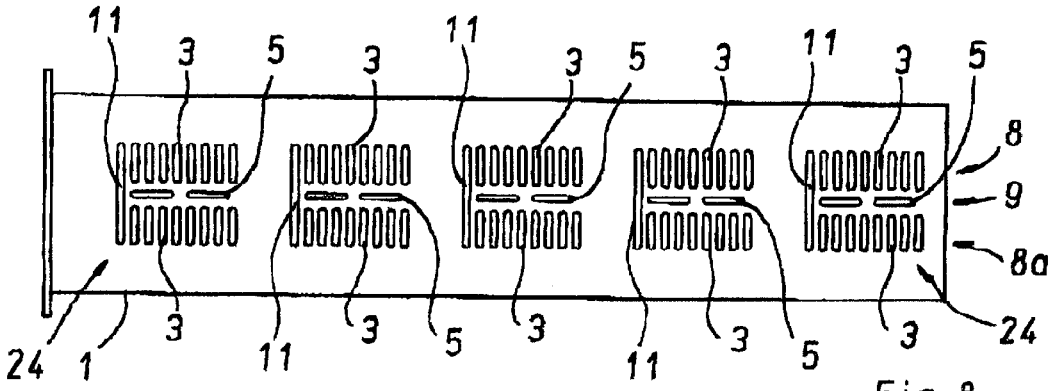
FIG. 8 is a view of a burner according to the invention, provided with a plurality of groups of slots, each group comprising two subgroups of evenly spaced slots separated by an intermediate portion of diffuser provided with further slots.

FIG. 8 shows a diffuser 1 of a burner provided with groups 24 of slots 3, each group comprising two sub-groups 8, 8*a* of evenly spaced slots 3. The sub-groups 8, 8*a* are separated from each other by the intermediate portion 10 of the diffuser, which is provided with a row 9 of further slots 5 that are substantially perpendicular to the slots 3.

An end slot 11 of each group 24 may have a length greater than the length of the slots 3, the length being substantially equal to the overall width of the group 24.

Figure 9:
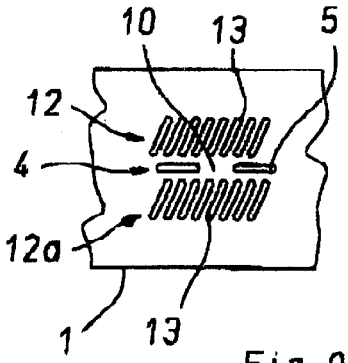
FIG. 9 is an interrupted view of a burner according to the invention provided with two rows of inclined slots and a row of further slots arranged in the intermediate portion of diffuser between the two rows of slots.

FIG. 9 shows a diffuser 1 of a burner similar to that of FIG. 3, but provided with rows 12, 12*a* of slots 13 which are slightly inclined with respect to a perpendicular to a median line of the intermediate portion 10.

Figure 10:
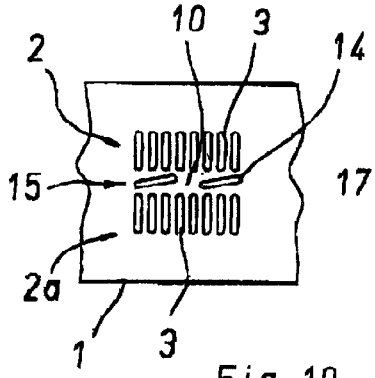
FIG. 10 is a view of a burner as in FIG. 9, provided with two rows of slots and a row of further slots arranged in the intermediate region between the two rows of slots, said further openings being all inclined in a same direction.

FIG. 10 shows a diffuser 1 of a burner similar to that of FIG. 3, but having an intermediate portion 10 of diffuser provided with a row 15 of further slots 14 slightly inclined in a same direction with respect to a median line of said intermediate portion 10.

Figure 11:
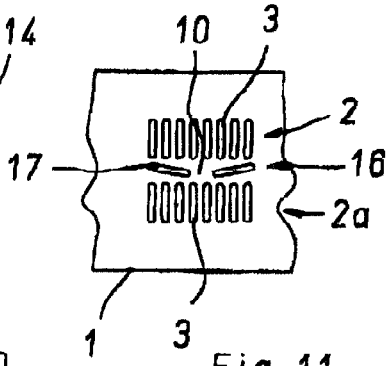
FIG. 11 is a view as in FIG. 10, but with the further slots alternately inclined in opposite directions.

FIG. 11 shows a diffuser 1 of a burner similar to that of FIG. 3, but having an intermediate portion 10 of diffuser provided with a row 16 of further slots 17, which are alternately slightly inclined in opposite directions with respect to a median line of the intermediate portion 10.

Figure 12:
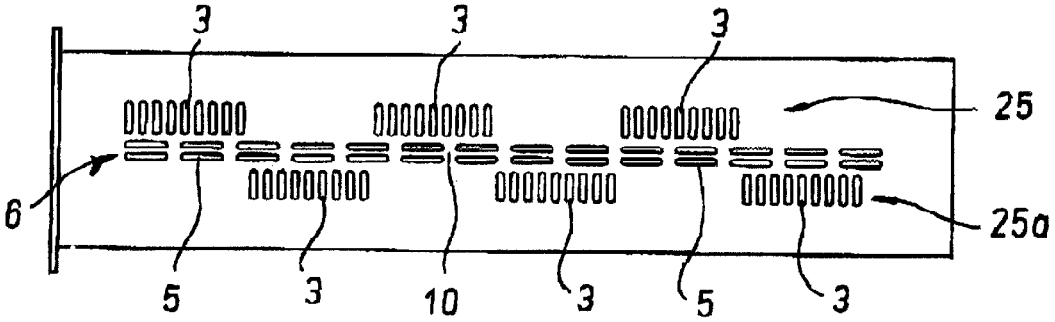
FIG. 12 is a view of a burner according to the invention provided with two interrupted and staggered rows of slots and two uninterrupted rows of further slota arranged in the intermediate portion of diffuser between the two rows of slots.

FIG. 12 shows a diffuser 1 of a burner provided with staggered groups 25, 25*a* of evenly spaced slots 3 arranged on either sides of the intermediate portion 10 of the diffuser; the intermediate portion 10 being provided with two rows 6 of further slots 5 arranged parallel to a median line of the intermediate portion 10.

Figure 13:
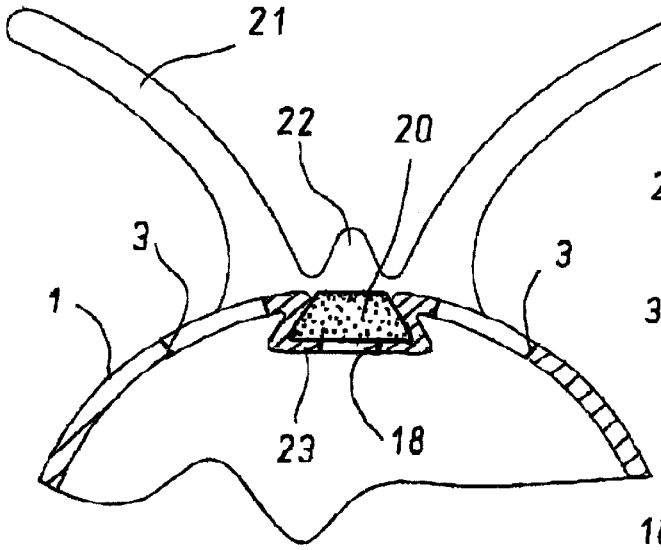
FIG. 13 is an interrupted view of a burner according to the invention provided with two parallel rows of slots separated by an intermediate portion of diffuser, a housing being provided in said intermediate portion for an insert of a porous or spongy heat-resistant material.
Figure 14:
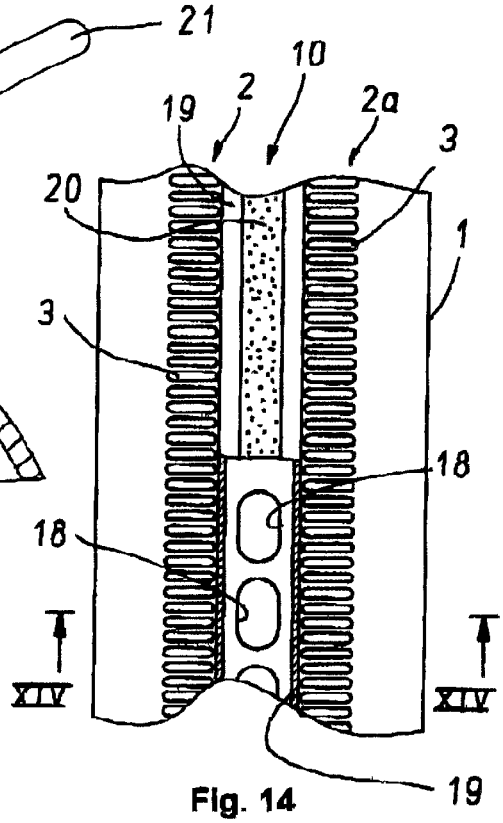
FIG. 14 is a section though a line XIV—XIV of FIG. 13.
Figure 15:
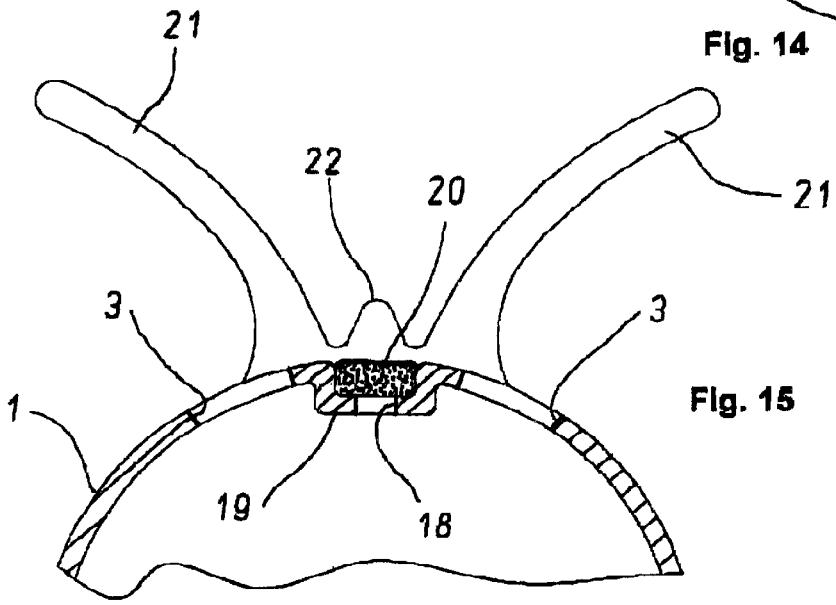
FIG. 15 is a section as in FIG. 14, but showing a different shape of the housing for the insert of porous or spongy material, made in said intermediate portion of diffuser.

FIGS. 13 to 15 show a diffuser 1 of a burner provided with two parallel, uninterrupted rows 2, 2*a* of evenly spaced slots 3, separated by the intermediate portion 10 of the diffuser, in which a housing 19 or 23 is provided. An insert 20 of porous or spongy heat-resistant material, for instance a ceramic material, may be inserted into the housing 19 or 23. The bottom of the housing 19 or 23 is provided with openings 18 for the mixture of air and gas-fuel, which flows through the openings 18 and passes through the porous or spongy material of the insert 20. In addition, the insert 20 may be made of a material having a reticular structure. The intermediate portion 10 itself may be made of a heat-resistant material, for instance a ceramic material, which may have a reticular structure.

The use of heat-resistant material makes it possible to heat the mixture of air and gas fuel flowing through the openings 18 made in the intermediate portion 10 of the diffuser, which increases the combustion speed of the mixture and makes it possible to obtain an extremely stable auxiliary flame 22, which anchors the main flames 21.

The use of a porous or spongy material makes it possible to reduce the speed of the mixture of air and gas-fuel, which passes through the material flowing through the passage openings 18 and generates the auxiliary flames 22, thus preventing the structure of the main flames 21 from being significantly affected.

What is claimed is:

1. A burner fed with a hyper-stoichiometric mixture, comprising;

a diffuser on which rows of similarly shaped and evenly spaced parallel slots for a flow of the mixture are provided, the rows being arranged on either sides of an intermediate portion of the diffuser having a substantially constant width, the intermediate portion being provided with further slots for the flow of the mixture that are not parallel to the parallel slots, the parallel slots being arranged in groups, and each group comprising parallel rows of the parallel slots with an end slot having a length greater than the length of the other slots of the group.

2. The burner according to claim 1, wherein the end slot has a length substantially equal to the overall width of the respective group of slots.

3. The burner according to claim 1 or 2, wherein said parallel slots are substantially perpendicular to a median line of said intermediate portion.

4. The burner according to claim 1 or 2, wherein said parallel slots are arranged inclined with respect to a median line of said intermediate portion.

5. A burner fed with a hyper-stoichiometric mixture of air and gas-fuel, comprising a diffuser on which rows of first slots for a flow of said mixture are provided, the slots of each row being similarly shaped, evenly spaced and parallel to each other, said rows being parallel to each other and arranged on either sides of an intermediate portion of said diffuser having a substantially constant width, said intermediate portion being provided with further slots for the flow of said mixture, wherein said further slots are non parallel to said first slots, said first slots being substantially perpendicular to a median line of said intermediate portion.

6. The burner according to claim 5, wherein said first slots are arranged in groups.

7. A burner fed with a hyper-stoichiometric mixture of air and gas-fuel, comprising a diffuser on which rows of first slots for a flow of said mixture are provided, the slots of each row being similarly shaped, evenly spaced and parallel to each other, said rows being parallel to each other and arranged on either sides of an intermediate portion of said diffuser having a substantially constant width, said intermediate portion being provided with further slots for the flow of said mixture, wherein said further slots are non parallel to said first slots, said first slots being arranged inclined with respect to a median line of said intermediate portion.

8. The burner according to claim 5, or 7, wherein said further slots are rectilinear.

9. The burner according claim 8, wherein said further slots are arranged parallel to a median line of said intermediate portion.

10. The burner according claim 8, wherein said further slots are arranged inclined with respect to a median line of said intermediate portion.

11. The burner according to claim 10, wherein adjacent slots of said further slots are inclined in opposite directions with respect to said median line.

12. The burner according to claim 5, or 7, wherein said further slots are curvilinear.

13. The burner according claim 12, wherein said further slots are arranged parallel with respect to a median line of said intermediate portion.

14. The burner according claim 12, wherein said further slots are arranged inclined with respect to a median line of said intermediate portion.

15. The burner according to claim 14, wherein adjacent slots of said further slots are inclined in opposite directions with respect to said median line.

16. The burner according to claim 5, or 7, wherein said further slots are arranged in at least one row parallel to a median line of said intermediate portion.

17. The burner according to claim 5, or 7, wherein said further slots are so shaped as the total rate of flow of the mixture of air and gas-fuel flowing through said further slots is less than the total rate of flow of the mixture flowing through said first slots.

18. The burner according to claim 5, or 7, wherein said further slots are so shaped as the speed of the mixture of air and gas-fuel flowing through said further slots is less than the speed of the mixture flowing through said first slots.

19. The burner according to claim 5, or 7, wherein the overall surface of said further slots is less than the overall surface of said parallel slots.

20. The burner according to claim 5, or 7, wherein said intermediate portion of the diffuser includes a heat-resistant material.

21. The burner according to claim 20, wherein said heat-resistant material has a porous or spongy structure allowing said mixture of air and gas-fuel to pass through said material.

22. The burner according to claim 21, wherein said heat-resistant material is a ceramic material.

23. The burner according to claim 20, wherein said heat-resistant material has a reticular structure.

24. The burner according to claim 23, wherein said heat-resistant material is a ceramic material.

25. The burner according to claim 20, wherein said heatresistant material is a ceramic material.

26. The burner according to claim 20, wherein said heat-resistant material is accommodated in a housing provided in said intermediate portion of diffuser.

27. The burner according to claim 26, wherein said heat-resistant material is provided with openings for passage of the mixture of air and gas-fuel.

28. The burner according to claim 20, wherein said heat-resistant material is provided with openings for passage of the mixture of air and gas-fuel.

* * * * *

UNITED STATES PATENT AND TRADEMARK OFFICE

CERTIFICATE OF CORRECTION

PATENT NO. : 6,561,795 B1 
DATED : May 13, 2003
INVENTOR(S) : Feliciano Lasagni et al.

It is certified that error appears in the above-identified patent and that said Letters Patent is hereby corrected as shown below:

Column 1,
Line 53, after "diffuser on which" insert therein -- parallel continuous, or non-continuous, rows of openings shaped as slots are made said rows being separated from each other by an intermediate portion of diffuser having a substantially constant width, characterized in that said intermediate portion is provided with a plurality of further openings for the flow of the mixture of air and gas-fuel --

Column 3,
Lines 61 and 66, after "diffuser" delete "l" and insert therein -- 1 --

Column 4,
Line 4, after "diffuser" delete "l" and insert therein -- 1 --

Signed and Sealed this

Twenty-eighth Day of October, 2003

JAMES E. ROGAN
*Director of the United States Patent and Trademark Office*